US005343551A

United States Patent [19]

Glucksman

[11] Patent Number: 5,343,551

[45] Date of Patent: Aug. 30, 1994

[54] HUMIDIFIER WITH REMOVABLE VAPORIZING UNIT FOR READY ACCESS TO HEATING ELEMENT AND EVAPORATION CHAMBER

[76] Inventor: Dov Z. Glucksman, 137 Larch Row, Wenham, Mass. 01984

[21] Appl. No.: 60,200

[22] Filed: May 7, 1993

Related U.S. Application Data

[60] Division of Ser. No. 843,542, Feb. 28, 1992, which is a continuation-in-part of Ser. No. 606,938, Oct. 31, 1990, Pat. No. 5,111,529, which is a division of Ser. No. 287,330, Dec. 21, 1988, Pat. No. 5,014,338.

[51] Int. Cl.[5] ..... F24F 6/00; F22B 1/28; H05B 1/02; H05B 3/78

[52] U.S. Cl. ..... 392/405; 261/142; 261/DIG. 48; 261/DIG. 65; 392/406

[58] Field of Search ..... 392/402, 403, 404, 405, 392/406; 261/142, DIG. 48, DIG. 65

[56] References Cited

U.S. PATENT DOCUMENTS

| | | | |
|---|---|---|---|
| 1,361,028 | 12/1920 | Drake | 392/405 |
| 1,749,969 | 3/1930 | Brodin | 392/406 |
| 1,756,053 | 4/1930 | Colton | 392/405 |
| 2,062,613 | 12/1936 | Schleimer | 392/405 |
| 2,211,407 | 8/1940 | Christensen | 392/405 |
| 3,201,772 | 8/1965 | Ladusaw | 200/81.9 R |
| 3,366,775 | 1/1968 | Mycue | 219/272 |
| 3,418,068 | 12/1968 | Gilbertson | 219/276 |
| 3,670,141 | 6/1972 | Dines | 219/271 |
| 3,743,780 | 7/1973 | Camp | 219/275 |
| 4,137,574 | 2/1979 | Collins | 219/273 |
| 4,274,588 | 6/1981 | Schwob | 219/273 |
| 4,635,630 | 1/1987 | Noir et al. | 128/203.26 |
| 4,725,700 | 2/1988 | Zoludow | 200/81.9 R |
| 4,752,423 | 6/1988 | Wong | 392/405 |
| 4,810,854 | 3/1989 | Jurisch et al. | 219/276 |
| 5,014,338 | 5/1991 | Glucksman | 392/405 |
| 5,067,169 | 11/1991 | Chiu | 392/406 |
| 5,073,967 | 12/1991 | Marino | 392/406 |
| 5,086,494 | 2/1992 | Wang | 392/405 |
| 5,111,529 | 5/1992 | Glucksman | 392/405 |
| 5,131,070 | 7/1992 | Chiu et al. | 392/405 |
| 5,133,044 | 7/1992 | Chiu | 392/405 |
| 5,143,460 | 9/1992 | Wang | 392/405 |
| 5,210,818 | 5/1993 | Wang | 392/405 |

FOREIGN PATENT DOCUMENTS

| | | |
|---|---|---|
| 883637 | 8/1979 | U.S.S.R. . |
| 1174569A | 5/1982 | U.S.S.R. . |

*Primary Examiner*—Anthony Bartis
*Attorney, Agent, or Firm*—Kenyon & Kenyon

[57] ABSTRACT

The components of an electric warm-air humidifier are enclosed in a housing resting on a base having a water supply compartment. The housing includes an evaporation chamber in the shape of an inverted cup which has a steam outlet in its top and contains an electric heating element positioned a short distance above its open end. The evaporation chamber and the heating element are immersed in water contained in the water supply compartment. The neck of an inverted, removable, water container filled with water is placed into the water supply compartment and water fills the water supply compartment until its level reaches the lower rim of the water container's neck. The housing and the water container are displaceable from the base so as to provide access to the water supply compartment and the heating element to facilitate cleaning. The humidifier also contains a control element to prevent damage to the heating element when the heating element is not immersed in water and signal lamps warning an attendant to refill the water container with water.

13 Claims, 11 Drawing Sheets

HUMIDIFIER WITH REMOVABLE VAPORIZING UNIT FOR READY ACCESS TO HEATING ELEMENT AND EVAPORATION CHAMBER

This application is a division of applicant's pending application Ser. No. 07/843,542, filed Feb. 28, 1992, which is a continuation-in-part of applicant's prior application Ser. No. 07/606,938, filed Oct. 31, 1990 and now U.S. Pat. No. 5,111,529 issued May 5, 1992, which is a division of 287,330 filed Dec. 21, 1988 now U.S. Pat. No. 5,014,338 issued May 5, 1991.

BACKGROUND OF THE INVENTION

The invention relates to a portable, electric air-humidifier, more particularly to an improved warm-air humidifier.

Air humidifiers have been found to be important in controlling the environment in homes during very dry weather, or in winter whenever outside air of low temperature is drawn inside and heated, causing the relative humidity in the home to be lowered to an uncomfortable degree.

Portable humidifiers are well known in the art, and may be classified as follows:

1. Steam generators which comprise a water container and an electric heating element submerged in the water, there being provided safety devices for switching off the current as soon as the water level drops below the heating element. A flow of hot steam is blown directly into the room to be humidified and there is always the danger of a person, especially a child, being scalded whenever he comes into contact with the jet of steam ejected, typically, at a temperature of about 212° F. Furthermore, the container of hot water, when overturned, may cause serious injuries to the person nearby.

2. Porous medium humidifiers generally include a porous medium structure partly submerged in cold water contained In an open vessel and a blower unit drawing air through the porous medium structure. The porous medium is either in the shape of a disc or a drum with part of the medium dipping into the water, which is slowly rotated while air is blown through the portion above the water level, thus carrying humidity into the room; or it is in the form a stationary body adapted to draw water into the upper non-immersed part by capillary action, from where it is carried into the room by air blown therethrough.

3. Ultra-sonic humidifier generally comprise a container filled with water which is brough to a vibration by high-frequency vibrator means which causes the water to be atomized. An air steam directed onto the water surface carries the mist into the room to be humidified.

The major drawback of both the two latter appliances is the fact that the water staying in the container is not heated to boiling point as in the steam generator and, therefore, is susceptible to the growth of microorganisms which are subsequently carried by the air stream into the room and ingested by the people staying there.

4. Warm-air humidifiers share the benefits of steam generators in that growth of micro-organisms is forestalled by heating the water to boiling point. Also, warm-air humidifiers avoid the drawback of hot steam entering the room, since in this type of humidifier the steam is carried into the room as a mist mixed with air, at a temperature to be selected by judiciously choosing the ratio of steam and air.

A typical warm-air humidifier is described in U.S. Pat. No. 4,564,746: it includes a heated evaporation chamber which is enclosed to prevent leakage or damage and a fan adapted for dispersing the generated steam into the room via a cabinet passageway. The evaporation chamber is mounted on tracks which permit its sliding out of its enclosure and is thus easily accessible for cleaning and servicing. The heating element which is operationally enclosed in the chamber is attached to a cover which is likewise movable out of the humidifier cabinet for cleaning and servicing.

The drawback of this humidifier is its relatively intricate and expensive design: according to the description, the heating element is attached to a movable cover which is provided with flexible tubing and must be moved upwards on vertical tracks in order to clear the top of the water enclosure, permitting the latter to be slide out sideways. It requires s significant amount of space and cannot be serviced except by a skilled person.

The humidifier disclosed in applicant's U.S. Pat. No. 5,014,338 and pending patent application Ser. No. 07/606,938 and in the present application have similar or substantially the same structure except as will be brought out hereinafter. For one thing, a steam ejector is provided in the present application which takes the place of the motor driven blower disclosed in applicant's mentioned patent and pending application. In terms of similar concepts and structure which are common to the mentioned patent, pending application and present application the various embodiments each employs base means having a water supply compartment separated into a filling compartment and a main compartment which is in communication with an evaporation chamber to provide water thereto for boiling. The evaporation chamber has an enclosure which projects into the main compartment and a heater is carried within the enclosure. The lower edges or the wall of the enclosure is spaced from the floor of the main compartment to form a passageway, whereby water flows therethrough to immerse the heater within the water. Structure, either in the form of removable trays or a displaceable housing containing the evaporation chamber, is utilized to obtain access to the trays or the heater for cleaning purposes.

Humidifiers employing motor driven blowers, such as is found in applicant's U.S. Pat. No. 5,014,338 and in pending application Ser. No. 07/606,938 have many benefits and advantages. On the other hand the use of warm air humidifiers utilizing motor driven blowers an at times deemed objectionable when used in nurseries and in bedrooms as being non-conducive to sleep because of the mechanical and aerodynamic noise associated with motor driven blowers. In addition, the presence of high humidity to which motor shafts are exposed creates rusting problems with the resulting binding of the shafts to the bearings. Obviously, this creates expensive maintenance problems and may inhibit the user from obtaining service because of the expense.

Certain criteria are desired in warm air humidifiers to maximize the desirability and efficiency of such devices for the user. One criterion is to maintain the steam-air mixture at a predetermined temperature which ranges between 37° C. and 65° C. (99° F.–149° F.) where the lower end of the range approximates human body temperature and the upper end represents a value at which the steam air mixture still may be brought into contact with a person's hand without the sensation of pain. Another criterion is to provide a uniform mixing of air and steam resulting in an even temperature profile at the outlet grille and avoiding non-uniform degrees of air saturation as well as local recondensation on portions of the grill.

The following relevant prior art has been found in a patentability search: U.S. Pat. No. 4,635,630; Soviet documents no's. SU1174569A and 883,637.

Accordingly it is an object of the present invention to provide an improved and novel non-motor driven warm-air humidifier which utilizes a simple and inexpensive structure and still obtains results equivalent to or better than those obtained by humidifiers employing motor driven blowers.

It is another object to provide an improved and novel humidifier which provides for the proper and uniform mixture of steam laden air having the proper ratio of air and steam and substantially uniform temperature profile at the outlet grille.

It is a further object to provide an improved and novel humidifier which employs a steam ejector in place of a motor driven blower and which exhibits significantly less objectionable noises than those employing motor driven blowers.

It is a still further object to provide a novel and improved humidifier which utilizes a steam ejector tube having a restricted throat portion therein and which is dimensioned and positioned in relation to a steam nozzle in which air steam flows at a certain velocity and produces a steam air mixture of the proper saturation and temperature substantially noise free or of minimum noise.

Another object is to provide a novel and improved gravity water-feed humidifier in which the constant pressure to drive the generated steam through a steam nozzle is maintained by a differential head of water existing between the steam generation compartment and the water supply compartment.

Further objects ad advantages of the present invention will become obvious to one skilled in the art in the following description of the invention and the claims.

SUMMARY OF THE INVENTION

The warm air humidifier, of the present invention, includes an evaporation chamber in the shape of an inverted cup which is provided with a steam nozzle in its top portion and the chamber contains an electric resistance heater close to its open bottom end. In a preferred embodiment, the evaporation chamber is capable of containing only a small volume of water, thus promoting rapid start operation. The open bottom end is immersed in the main compartment of a water supply compartment which also includes a filling compartment supplied with water from a portable jug positioned on a base which includes the water supply compartment. The water supply compartment is kept filled with water to a predetermined level by the jug allowing water to flow into the compartment only as high as the rim of the neck of the jug. The pressure within the evaporation chamber, which is generated by the steam therein, is maintained constant by a differential head which exits between the higher level of the water in the water supply compartment and the lower level of the water in the evaporation chamber.

More specifically, and as shown in the drawings and discussed in detail below, the portable warm air humidifier of this invention, comprises a refillable water container having a discharge opening, a top portion housing defining a vapor passage having a portion defining an evaporation chamber for collecting vapor and a vapor outlet opening for discharging vapor collected from the evaporation chamber, an electrically energized heating element provided within the evaporation chamber, and a base having a water supply compartment comprising a main compartment and a filling compartment in communication with each other. The base is devoid of electrical components and circuitry. The water container and the top portion housing are supported and accommodated on the base in cooperative relationship with the compartments and a re disposed in juxtaposition with each other and movable and displaceable from and with respect to the compartments on the base so as to provide access to the compartments and the heating element. The water container has its discharge opening projecting into the filling compartment to supply water thereto and to the evaporation chamber having its lower end portion projecting into the main compartment to immerse the heating element in water in the main compartment so as to effect the vaporization of water into vapor. The top portion housing, when moved and displaced in a direction away from the main compartment, effects the withdrawal of the heating element from the main compartment to permit access to the heating element and to the interior of the main compartment to facilitate cleaning thereof. The evaporation chamber is in the shape of an inverted cup and defines a restricted enclosure enclosing the heating element. An open bottom end portion, i.e. the open end of the "cup" of the evaporation chamber, defines a passageway and provides water communication between the main compartment and the restricted chamber and provides physical access to the heating element so as to permit cleaning thereof.

The humidifier may be provided with a switch means operatively connected to the heating element and adapted to automatically provide deenergization thereof in response to sensing that the heating element is not immersed in water.

DETAILED DESCRIPTION OF THE INVENTION

Figure 1:
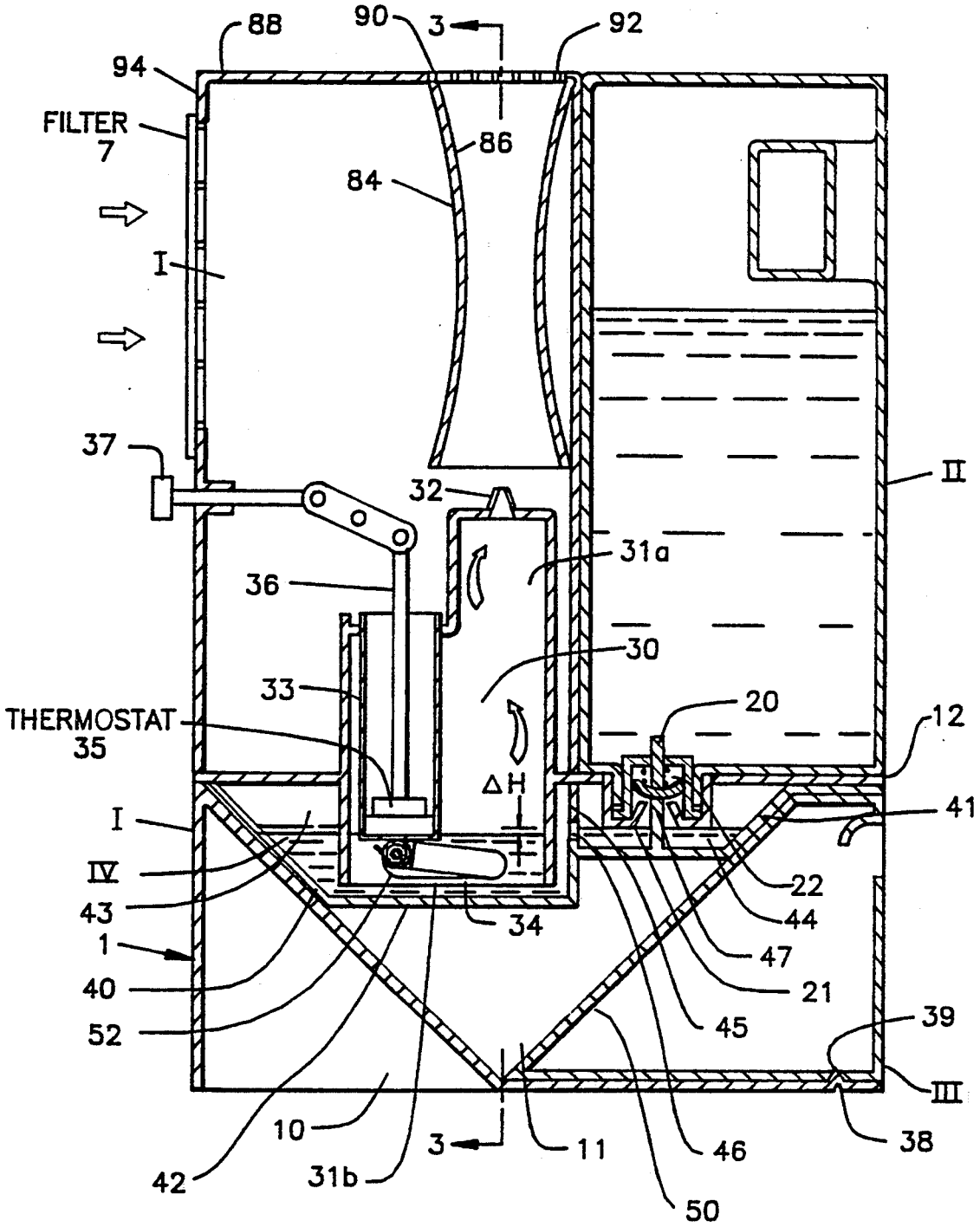
FIG. 1 is a vertical section through the warm-air humidifier of the invention and through an inverted water container in position on the base means of the humidifier.
Figure 2:
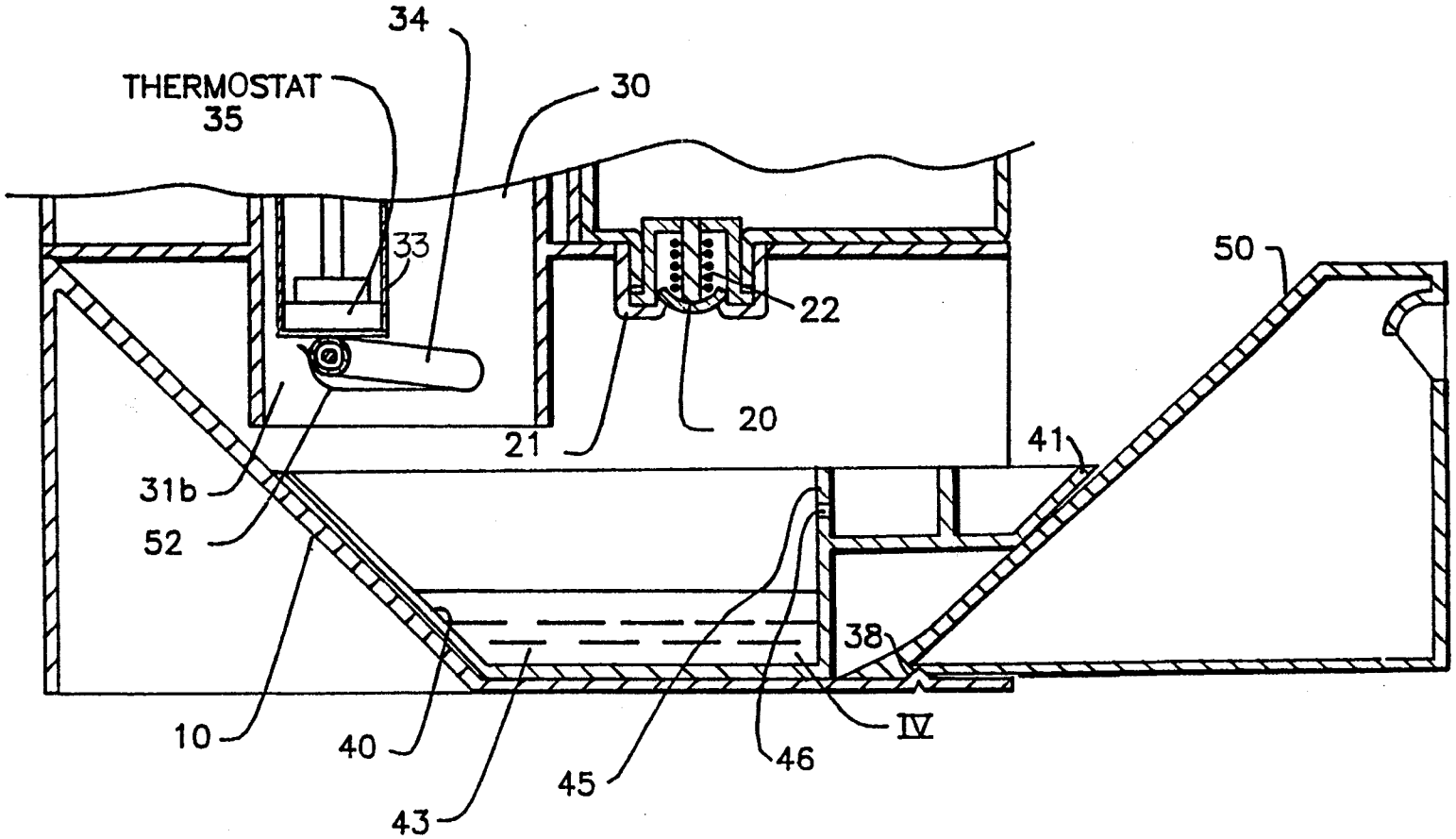
FIG. 2 is a vertical section through the bottom portion of the humidifier illustrated in FIG. 1, showing the tray in lowered position ready for removal.
Figure 3:
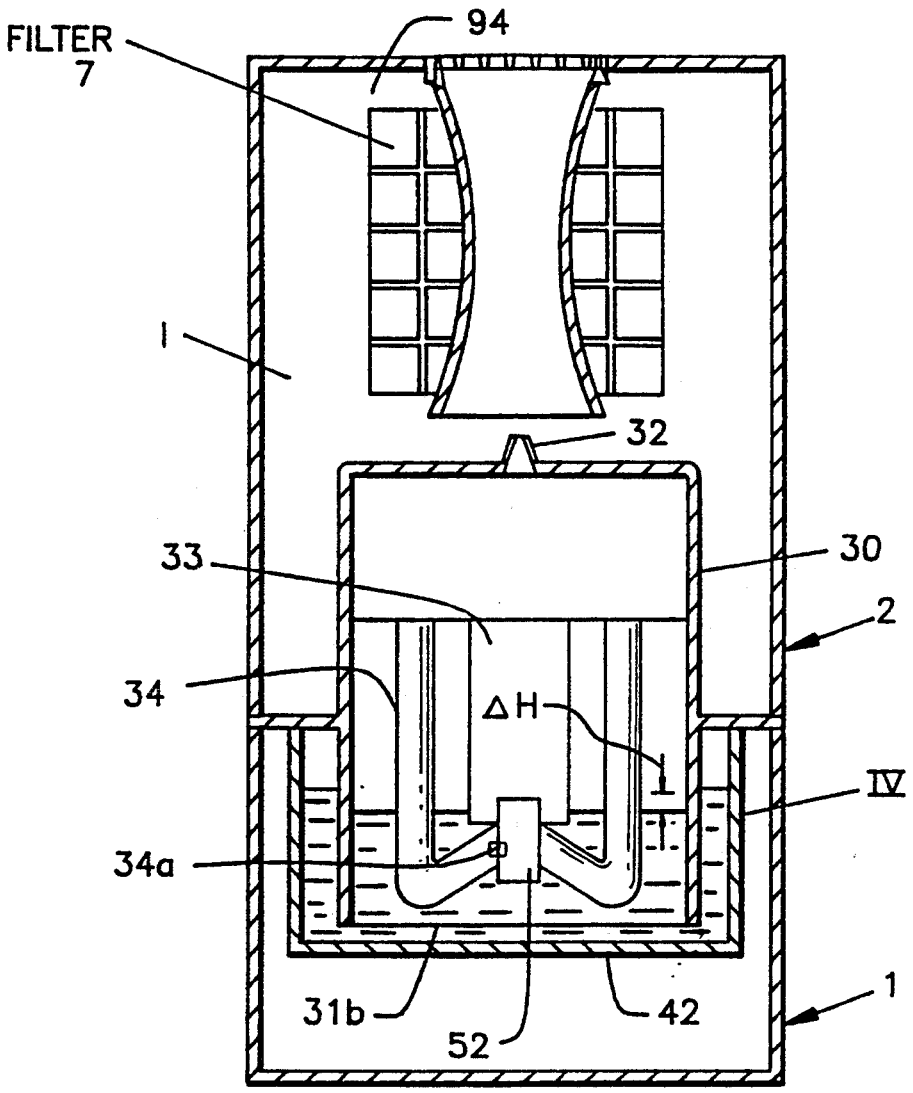
FIG. 3 is a section through the warm-air humidifier along line 3—3 of FIG. 1.
Figure 4:
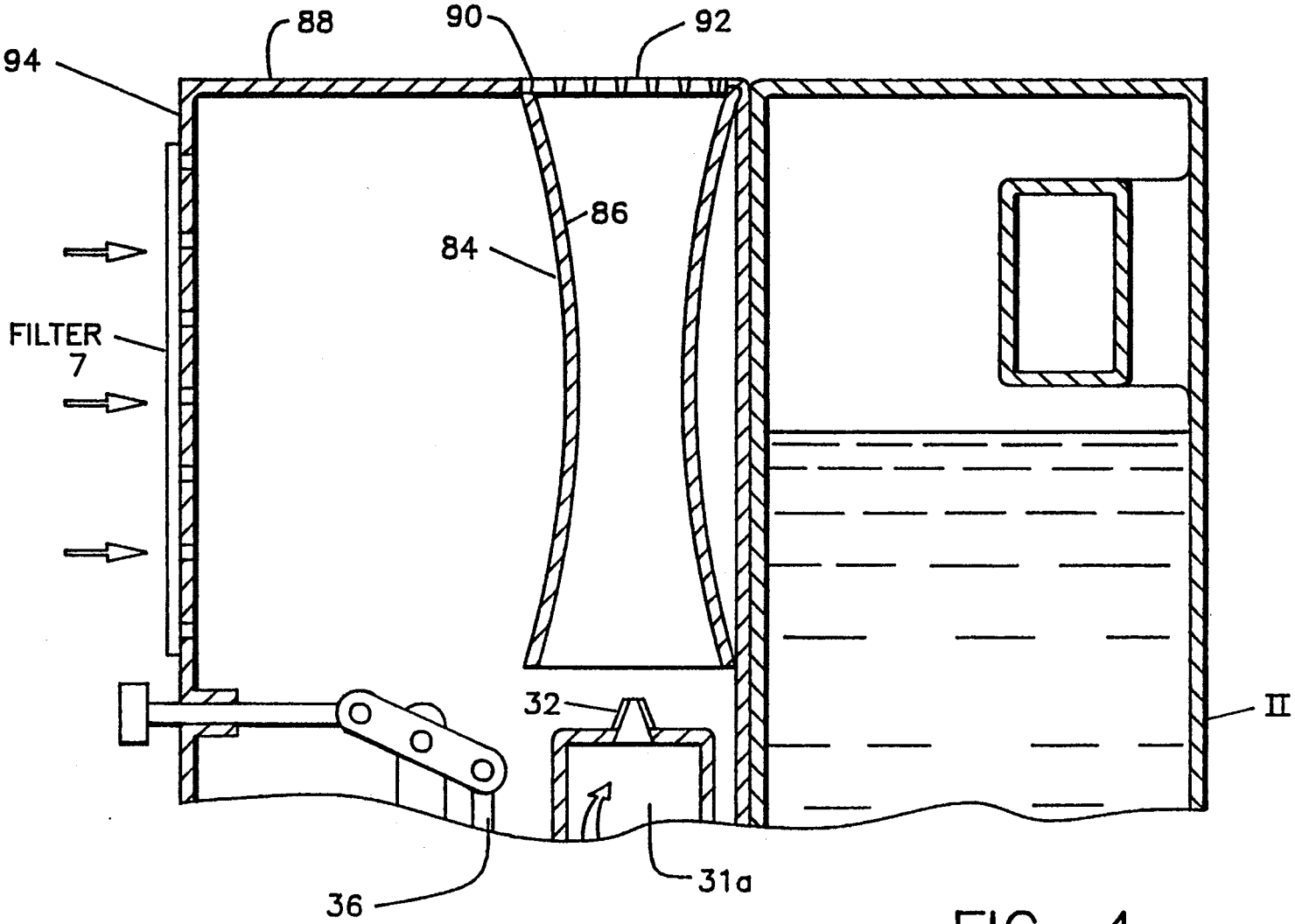
FIG. 4 is an enlarged fragmentary vertical section through the top portion of the humidifier illustrated in FIG. 1.

The components of the warm-air humidifier, as shown in FIGS. 1 and 2, are enclosed in a housing I including a base portion I and a top portion 2, the base being configured to support a water jug II in upside-down position. The base contains a drawer III of trapezoidal cross section which forms together with a sloping inner wall 10 of the base, a "V"-shaped trough 11. A tray IV is supported by the respective sloping walls 10 (of the housing) and 50 (of the drawer), whereby the contours of two opposite side walls 40 and 41 of the tray correspond in slope to the inclination of the two walls, while the tray bottom 42 is substantially flat. The tray includes a main compartment 43 and a filling compartment 44, in proximity to the drawer wall 50, which are separated by a partition 45 perforated by a connecting port 46. A vertical pin 47 projects from the bottom of the filling compartment and connects with a spring-supported valve 20 in the neck opening 22 of the inverted jug II. In order to keep the drawer in position inside the housing a tongue 38 projects upwardly from the bottom of the housing and engages an opening 39 in the bottom of the drawer when this is in closed position.

The top portion of housing 2 includes an evaporation chamber 30 in the shape of an inverted cup which extends into the base portion 1 and into the main compartment 43 of the tray, stopping short of the flat bottom 42 with a narrow gap remaining between the lower rim of the chamber and the bottom. The chamber top is stepped, forming a higher portion 31*a* which contains a steam nozzle 32, and a lower portion 31*b* into which a flask-shaped member 33 is inserted and hermetically closed to prevent steam from escaping therethrough. Member 33 holds a thermostatic switch 35, as well as a set of levers 36 serving for resetting the switch by means of knob 37. The tray, as well as the bottom of the evaporation chamber is filled with water, its upper level being defined by the lower rim 21 of the valve 22 in the neck of the jug II. An electric heater 34 is fully immersed in the water, and is held at its portion 34*c* closest to member 33 in intimate contact with the member 33 by means of a clip 52. The heater is switched off as soon as the water level drops below the raised portion 43*a* of the heating element due to lack of water in the jug.

For operation of the humidifier, the jug II, full of water, is placed with its valve 22 onto the filling compartment whereupon the pin 47 urges the valve body 20 upwards off its seat and permits water to flow into the tray. Water flows out of the filling compartment 44 into the main compartment 43 through the port 46 in the partition 45, the level being defined by the rim 21 of the jug's neck; for the reason that no air can flow into the jug through the neck as soon as it is covered by water and, obviously no water can flow out.

Due to evaporation, the water level in the tray will drop below the height of the rim of the jug, permitting more water to enter the tray and keeping it filled to the predetermined level. For the purpose of cleaning the tray, the drawer III is pulled out of the housing, causing the tray to slide down along the inclined wall 10 of the housing as shown in FIG. 2 of the drawing. At the same time, the pin 47 in the filling compartment is taken out of contact with the valve 20 of the jug, thereby closing the neck opening and preventing water from flowing out into the tray. The drawer III can now be withdrawn from the housing and the tray IV can be taken out.

A vertically disposed steam ejector tube 84 is provided within housing I immediately above the steam nozzle 32. Tube 84 is made of any suitable material and preferably may be formed from a plastic, such as, polypropylene, which is molded to the preferred shape disclosed. At its lower portion tube 84 is flared outwardly and then narrows to a throat 86 and thereupon the tube flares outwardly and towards the top 88 of top portion 2 of housing I. Top 88 has an outlet opening 90 (FIG. 1), the walls of which seat the circumferential edge of tube 84 at that point, A grille 92 is provided at opening 90 to direct the flow of air from tube 84 and into a room. Housing I may also include side wall 94 having a removable air filter 7.

Since the compartment 43 and 44 are in liquid communication with each other the water level in both compartments will be the same height. When heating element 34 is energized, the water in compartment 43 and particularly in evaporation chamber 30 begins to boil and steam is formed. The pressure of the generated steam, as present in the space in evaporation chamber 30, forces the level of water therein to a level below the level of the water in compartment 43 outside of evaporation chamber 30 and in compartment 44, to provide a differential head which in effect maintains the pressure within evaporation chamber 30, This pressure forces or drives the steam out of evaporation chamber 30 through steam nozzle 32 at a predetermined velocity. The existing steam then flows up into steam ejector tube 84 where it enters throat 86. The restricted dimensions of throat 86 create a region of low pressure, which in conjunction with other phenomena to be described hereinafter, sucks or draws air in from the interior of housing I to form a steam-air mixture which discharges through outlet opening 90 in the top 88 of the top portion 2 of housing I.

The use of the steam ejector concept in the present invention requires an understanding of certain phenomena which makes practical the application of this concept to gravity feed portable warm air humidifiers. A steam ejector requires a high velocity of steam from a nozzle and through an ejector tube in order to provide a proper mixture of steam and air having the desired ratio, as well as temperature. Firstly, a consideration of the steam velocity should be made, it being known that the velocity of steam through the nozzle is a function of the following:

A = The cross-section area of the nozzle expressed in centimeters squared ($cm^2$)

G = Rate of steam generation in grams per second (Gr/sec)

$\rho$ = The density of the steam in grams per centimeter cubed ($g/cm^3$)

Thus:

$$V(cm/sec) = G \div (\rho x A)$$

The rate of steam generation is a direct function of the power input G = KxEP

Where

EP = electric power in watts

K = a constant dependent on the latent heat of water and

According to Bernouli's equation, the pressure required to drive this steam through the nozzle at a velocity (V) is $$P \div \pi = V2 + 2g \text{ (g=gravitational acceleration)}$$

Applying the foregoing to the present invention, the pressure (ΔP) within evaporation chamber 30, translates to a difference in water level (66 H) by which the water level in evaporation chamber 30 is lower than the water level in compartments 43 and 44 which supply water to evaporation chamber 30. As will be obvious from the description above, as the water is boiled off in evaporation chamber 30, the water therein slowly recedes. This causes water to seep into evaporation chamber 30 from compartments 43 and 44 and through the space between the lower edges of evaporation chamber 30 and bottom 42 in compartment 43 to replenish the water boiled off. In the structure of the humidifier employed, it is found that the head available is in the range of ½" to ¾" or 1.25 cm to 2.0 cm which furthermore provide steam velocities of 1,000 to 3,000 feet per minute (fpm) or 5–15 meters per second (m/sec). Since an objective of the present invention is to reduce the noise of operation of a humidifier, steam velocities through steam nozzle 32 are of a humidifier, steam velocities through steam nozzle 32 are maintained below 2,000 fpm, or a rate of steam flow below 0.5 gr/sec cm$^2$ because to go above it would result in objectionable "hissing" sounds.

Figure 9:
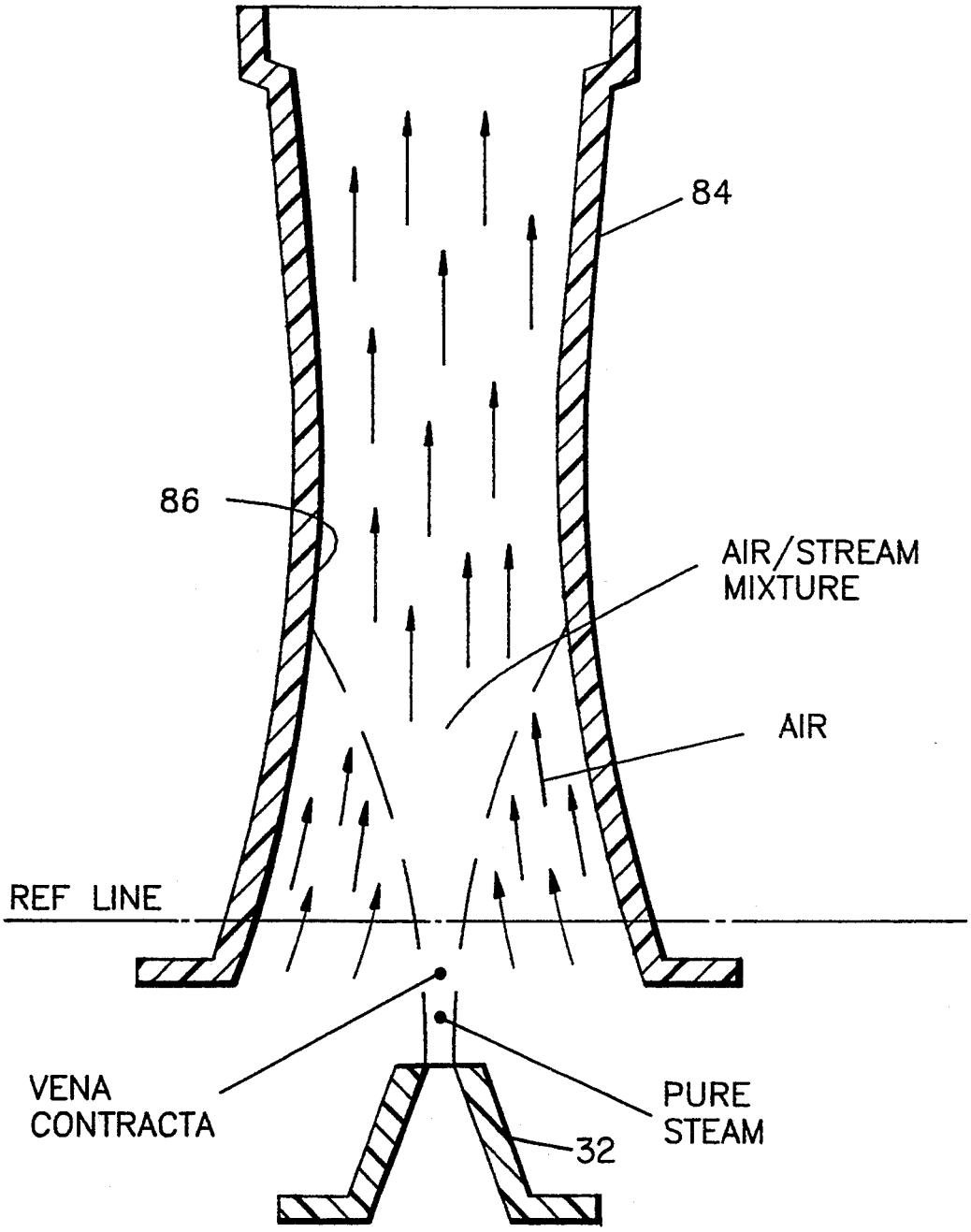
FIG. 9 is an enlarged view of the steam ejector tube and of the steam nozzle to graphically show the flowing streams of steam and air.

The action of the steam flow through ejector tube 84 to produce the desired results with the present invention may be explained by reference to FIGS. 9 and 10. In FIG. 9 the steam jet emerging from steam nozzle 32 is at a high velocity and after leaving the nozzle enters an area known as "vena contracta" whereupon it starts diverging. The steam jet while traveling through the "still" air causes the air next to it to move with it through the exertion of sheer-force.

Figure 10:
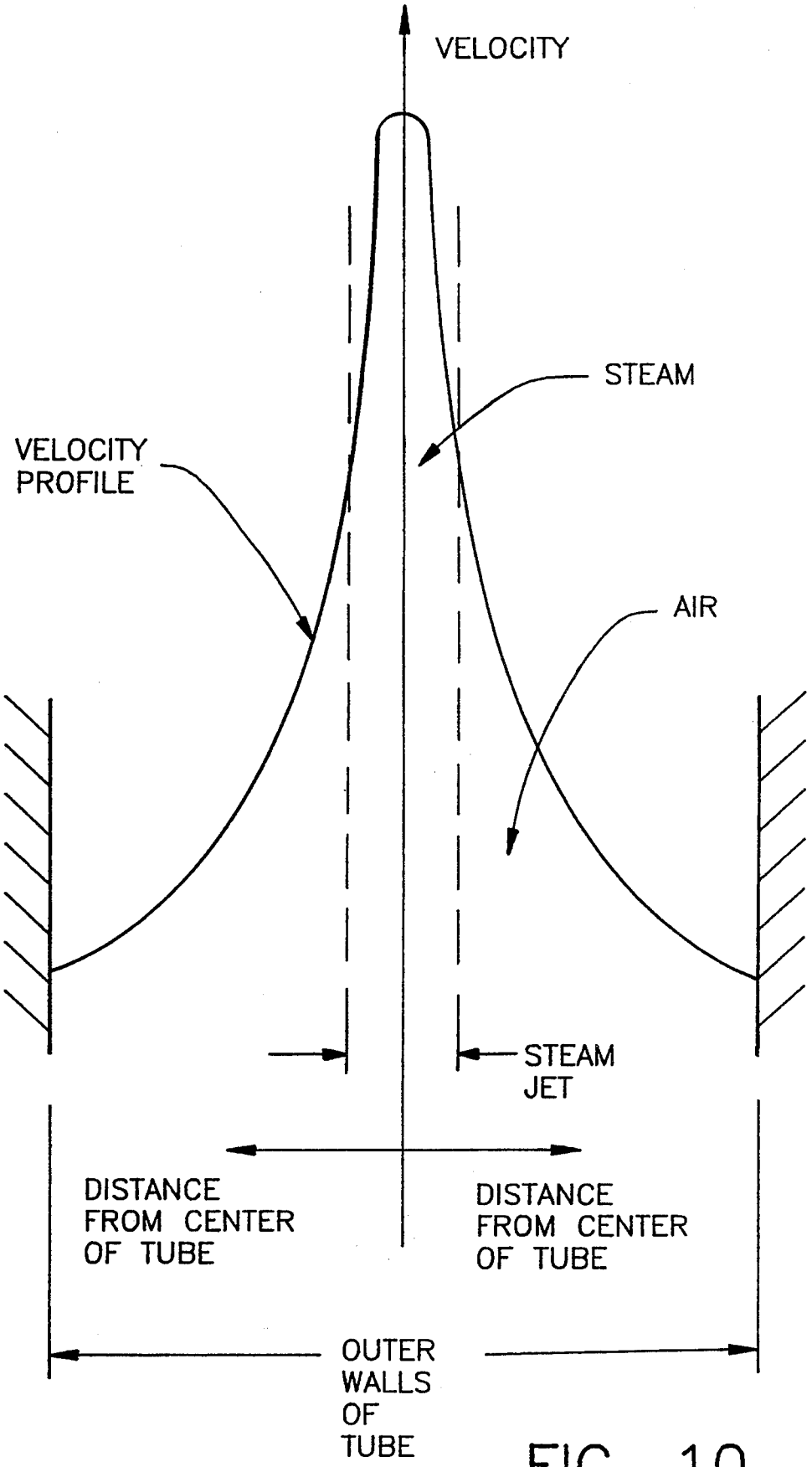
FIG. 10 is a graphical representation of a velocity distribution plot of the phenomena occurring within the steam ejector tube of FIG. 9.

The movement of air next to the steam jet will carry along the air particles next to it, and so on, until a velocity profile as shown in FIG. 10 is achieved. As the steam jet moves further away from the nozzle it expands and entrains the air until a substantially uniform mixture of air and steam is established in an around the narrowest area of the tube, which is the throat 86. As the mixture passes the throat and moves towards the upper end of the tube, the mixture rises due to the upwards impetus provided by the steam and by the buoyancy of the warm, moist air mixture which is lighter than dry cool air.

FIG. 10 illustrates, in a graphic manner, the air and steam velocity distribution as measured along the "ref. line" of FIG. 9. The line described as "velocity profile" is the locus of all the individual velocity measurements taken along the "ref. line" of FIG. 9. it should be noted that along the "ref. line" there is still very little mixing of air and steam and therefore a region of pure steam and pure air can be identified, as pointed out by the terms "steam" and "air".

It was found in constructing the humidifier of the subject invention that certain dimensions of the ejector tube 84 had to be adjusted as follows:

As was brought out above, the rate of steam flow out of steam nozzle 32 is preferably maintained below about 0.5 gr/sec cm$^2$. Furthermore, in order to obtain an outlet moist air temperature between about 42° C. and about 65° C., the ratio between the throat diameter and the distance of throat 86 from the steam nozzle 32 should be in the range of about 0.5 to about 0.75.

Moreover, it was also determined that the ratio of the diameter of the steam nozzle 32 to that of the throat of the ejector tube 84 should be in the range of about 0.1 to about 0.25.

Figure 5:
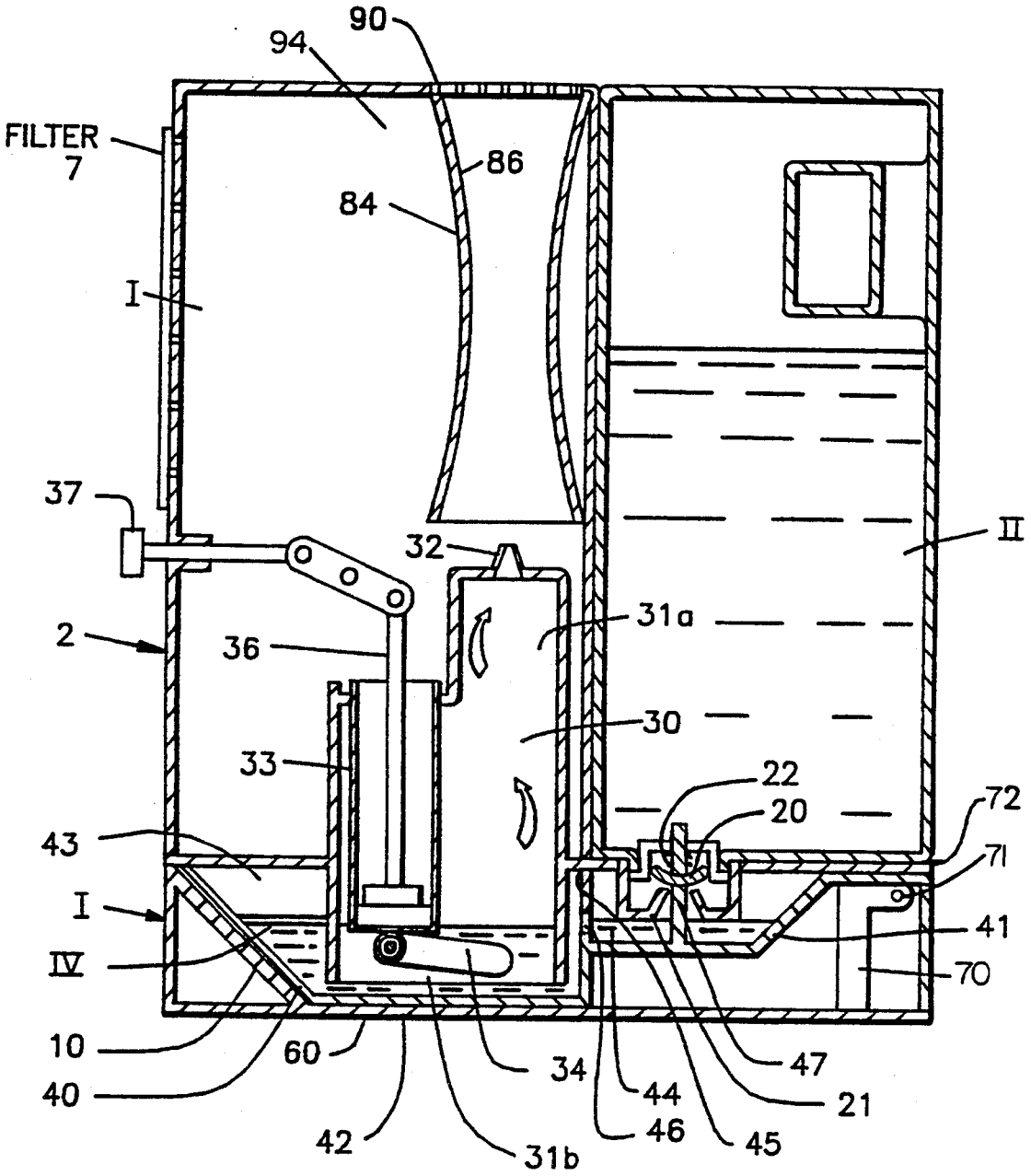
FIG. 5 is vertical section of a second embodiment of the warm-air humidifier containing a hinged evaporation chamber, shown in position on the base means.
Figure 6:
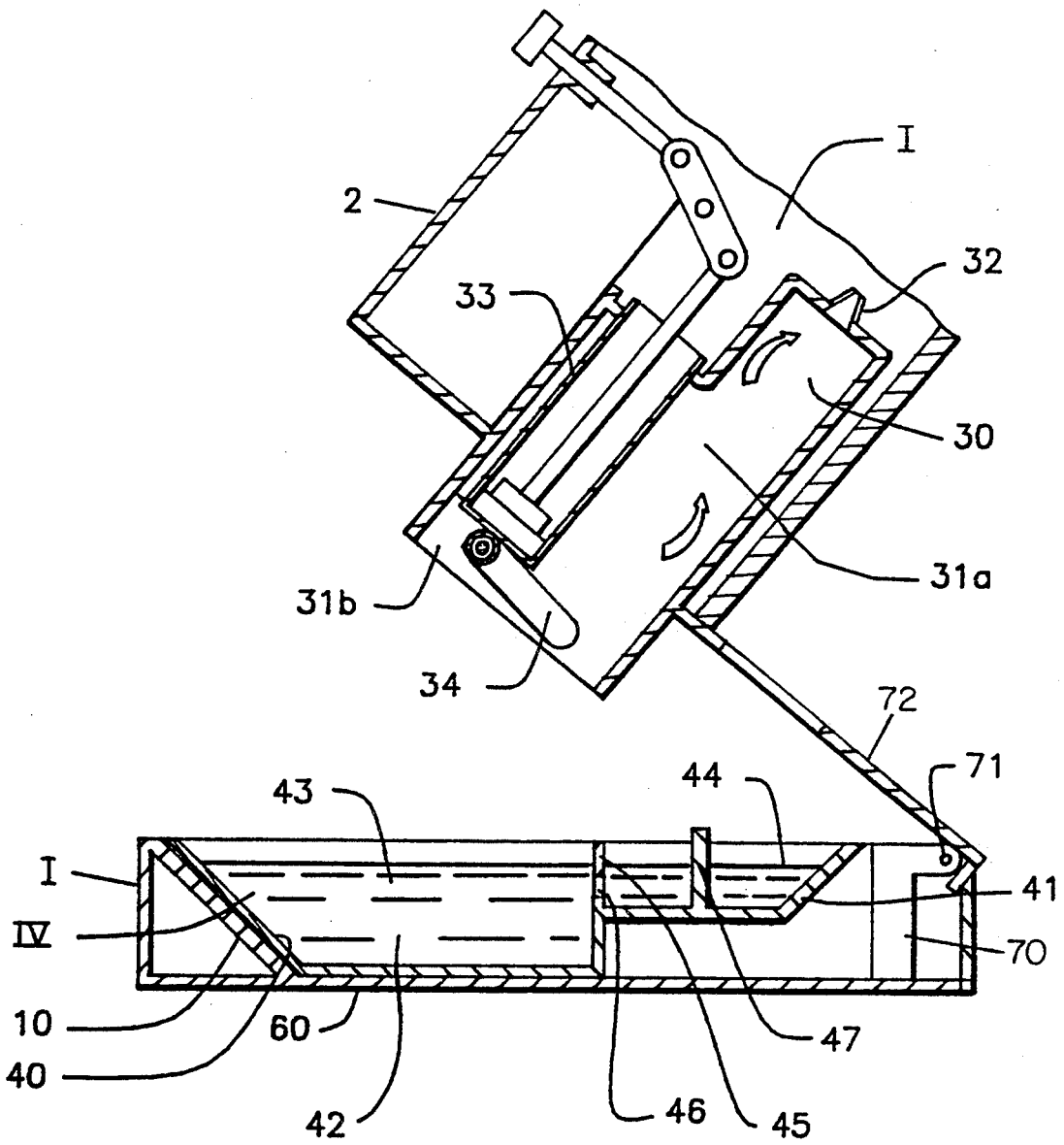
FIG. 6 is a vertical section of the warm-air humidifier FIG. 5 showing the evaporation chamber displaced away from the base means.

FIGS. 5 and 6 show another embodiment of the present invention. In this warm-air humidifier, top portion 2 is hinged, allowing easy access to the tray IV. In FIG. 5, illustrating the resting of the top portion 2 on the base portion I, the lower portion 31*b* of evaporation chamber 30 is surrounded by the tray IV area. A hinge assembly, comprising a hinge 71 and a hinge support member 70, are attached to the jug support platform 72, allowing the top portion 2 of the housing I to be moved to an open position, as shown in FIG. 6. These figures also show an embodiment of the invention which does not include a drawer. In this embodiment, base 60 supports the tray bottom 42. When the top portion 2 is moved to its open position, the tray IV is exposed, allowing its easy removal.

Figure 7:
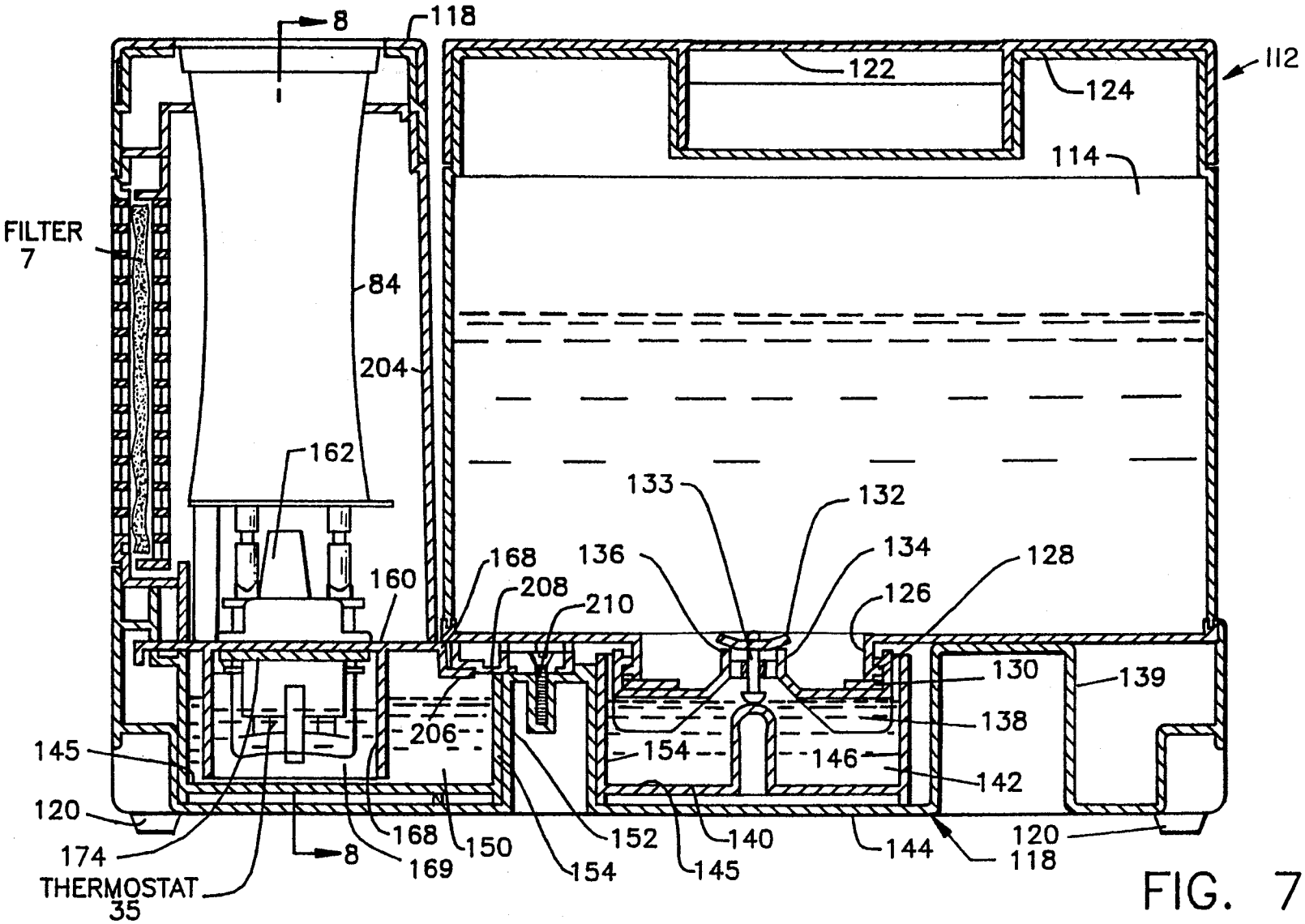
FIG. 7 is a section in elevation, of a third embodiment of the present invention.
Figure 8:
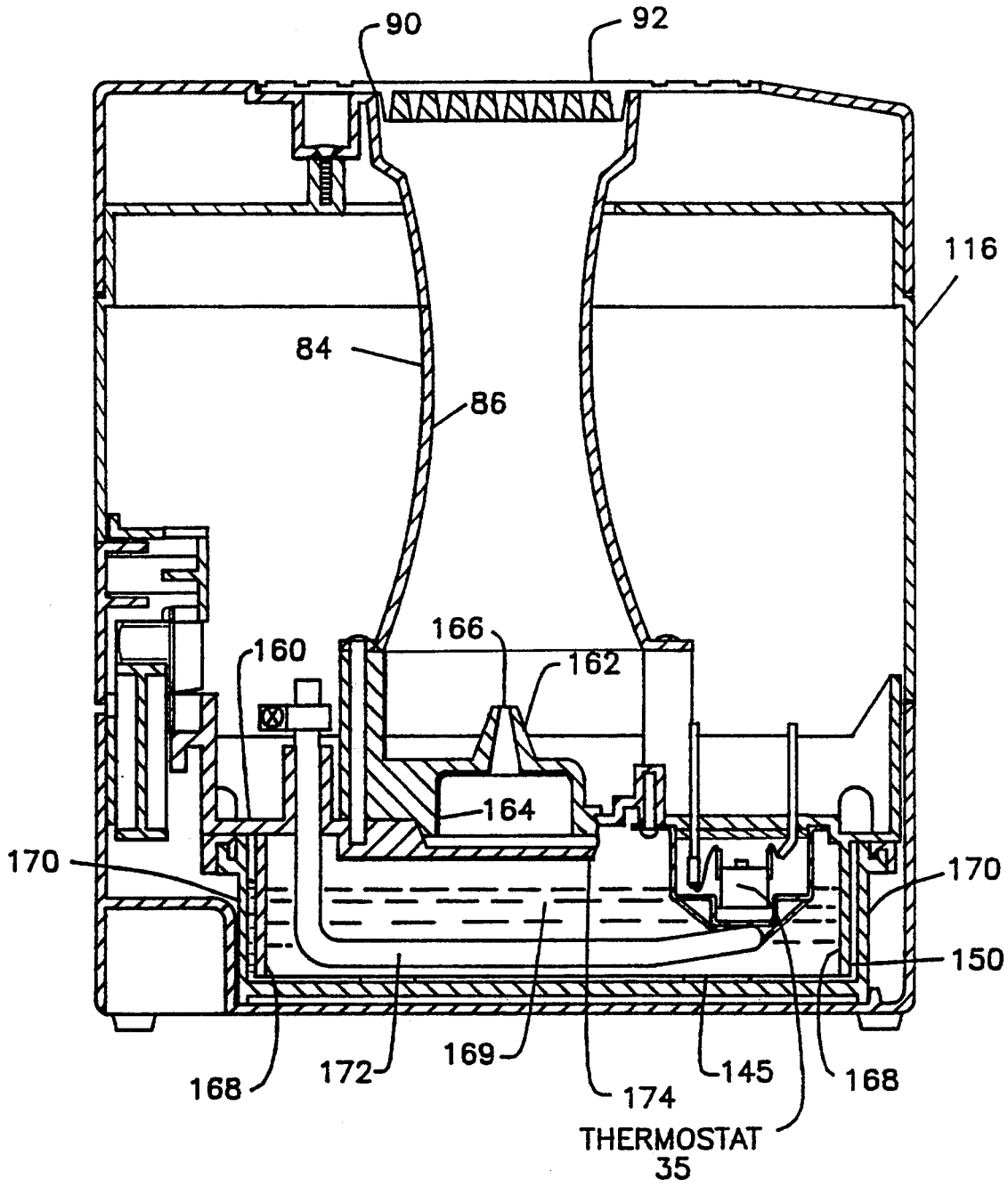
FIG. 8 is a section, in elevation, taken along the line 8—8 of FIG. 7.

A third embodiment of the present invention is disclosed in FIGS. 7 and 8 incorporates much of the components and concepts found in FIGS. 1 through 6 and FIGS. 9 and 10 except for some slight differences in structure as will become apparent from the description that follows.

Referring now to FIGS. 7 and 8, the portable warm-air humidifier is generally designated by the reference character 112 and includes a water container 114 disposed in juxtaposition with a housing 116, both of which are seated on a base 1118 provided with feet 120 for placement on a flat surface (not shown). Water container 114 is provided at its top (FIG. 7) with a convenient handle 122 situated in a recess 124 to permit the manual grasping of the handle 122 to remove and carry the container from base 118. The bottom of container 114, as better seen in FIG. 7, has a neck 126 with external threads 128 on which a sap 130 may be tightened. A spring biased valve 132 (springs not shown) having a valve stem 133 disposed in cap 30 and is normally biased for seating on the walls 134 of an opening 136. Extended wing members 138 are provided to assist in the screwing and unscrewing of cap 130 from neck 126. After the container is filled and capped it is positioned as shown in FIG. 7 where it is supported on base 118 on integrally formed hollow projects supports 139 (one shown in FIG. 7).

Figure 11:
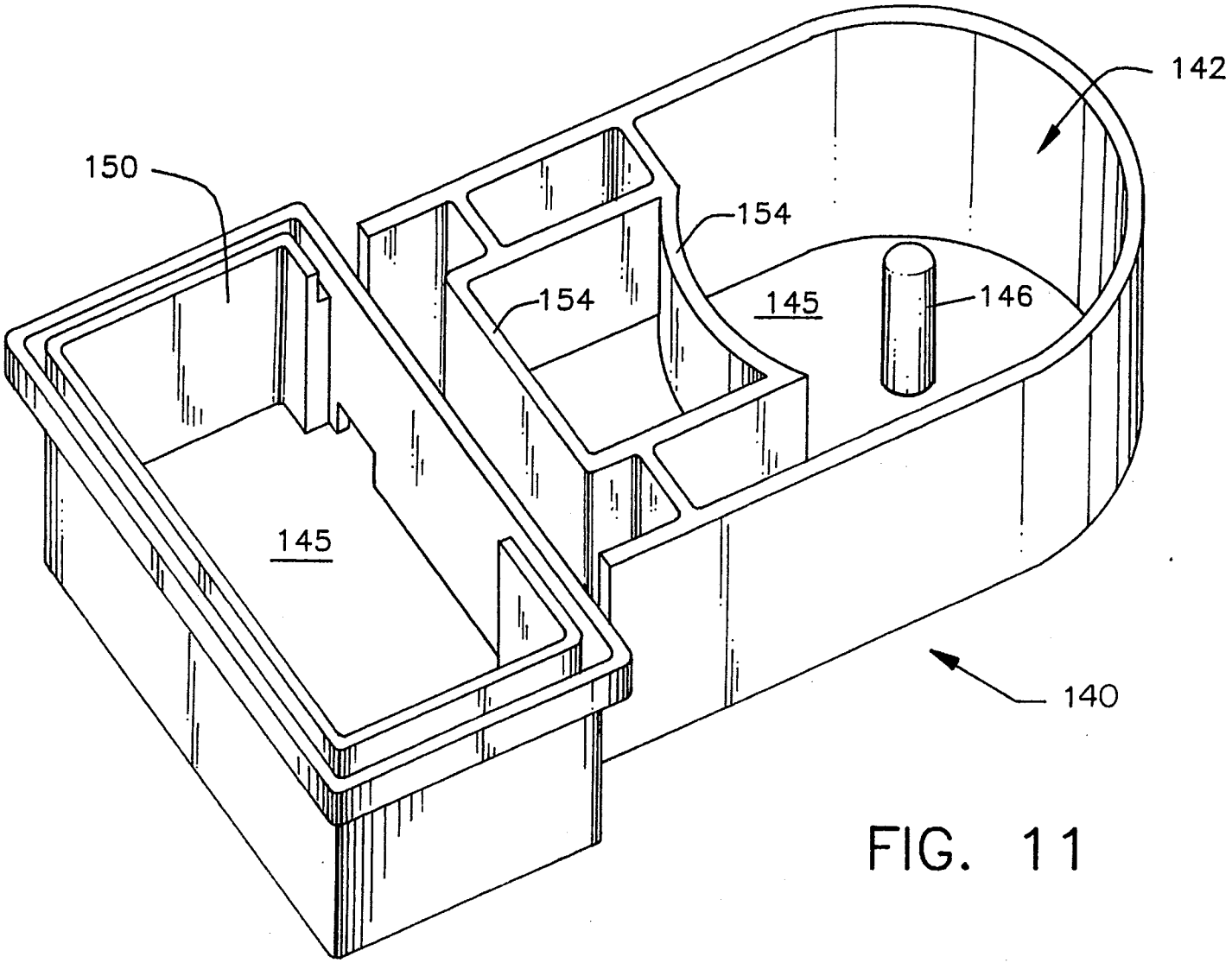
FIG. 11 is an isometric view of the tray shown in FIGS. 7 and 8.

Base 118 is substantially hollow and accommodates a removable tray 140 (shown in FIGS. 7, 8 and 11) resting on a floor 144 of base 118 and the tray has a filling compartment 142 to receive neck 126 of container 114. Tray 140 corresponds to tray IV in the first and second embodiments herein as seen in FIGS. 1–6, in terms of each being easily assessed and removable for cleaning. Furthermore, the trays of each embodiment has a filling compartment and a main compartment. A floor 145 of compartment 142 has an upstanding molded pin 146. As seen in FIG. 7, when container 114 is positioned on base 118, pin 146 engages valve stem 133 to displace valve 132 upwardly, permitting water to flow from the container through opening 136 into a filling filling compartment 142 of tray 140. Tray 140 has a second or main compartment 150 formed integrally with compartment 142, to the left of the latter as seen in FIG. 7. An upstanding post 152 is formed integral with floor 144 of base 118 and is positioned between compartments 142 and 150 between upstanding walls 154 of tray 140. Compartment 142 is substantially circular in horizontal cross section to accommodate neck 126 whereas compartment 150 is substantially rectangular in horizontal cross-section. Compartments 142 and 150 of tray 140 are in communication with each other in that water from compartment 142 readily flows therefrom into compartment 150, whereby the level of water in compartment 150 will always be a the level in compartment 142.

Housing 116 is provided with a rectangular shaped floor 160 which substantially seals off the interior of housing 116 from compartment 150 of tray 140 except for an opening in which the lower portion of a steam nozzle 162 is seated. As better seen in FIG. 8, nozzle 162 has an enlarged circular lower portion I64 leading to a narrowed and substantially cylindrical jet opening 166. Floor 160 has integrally formed therewith a depending wall 168 which extends perimeterically of the floor and projects downwardly into compartment 150 of tray 140 to form an evaporation chamber 169. The wall 168 is positioned in close proximity to the walls 170 of compartment 150. The lower edges of wall 168 also extend closee to the floor 145 in compartment 150 but are spaced therefrom as to permit water in tray 140, and particularly compartment 150, to readily flow between compartment 150 and evaporation chamber 169. An electrical heating element 172 is provided in evaporation chamber 169, which when energized, heats the water to boiling to generate steam therein which escapes chamber 169 through steam nozzle 162. A plate or baffle 174 is secured adjacent to lower portion I64 of nozzle 162 and in the path of flow of steam to interrupt and minimize the discharge of water droplets from the compartment with the steam, as well as to muffle to some extent, the boiling sound of water.

The outer sidewall 204 of housing 116 has an extension or lip 206 which projects below floor 160 and into compartment 150 of tray 140 for engagement by a latch 208 which is mounted on post 152 for pivotal movement by a screw 210. When container 114 is removed from base 118, access may be obtained to latch 208, to pivot it out of engagement with lip 206 to permit the housing 116 to be lifted off of base 118 and thereby allow access to heater element 170 for purposes of cleaning and the like.

The present invention as embodied in the third embodiment shown in FIGS. 7 and 8 operates in similar manner as the first two described embodiments in the generation of steam in admixture with air. The humidifier of the third embodiment, as is obvious from the description and explanation hereinbefore, differs in that the housing containing the evaporation chamber may be removed completely from the base whereas in the second embodiment the equivalent structure is pivoted to the base as at 71 (see FIGS. 5 and 6). It is apparent that there is no basic change in concept in that either structure permits displacement of the evaporating chamber from the base to obtain easy access to the heater element. Also, the latching structure which includes latch 208 and lip 206, permits the positive latching of housing 116 on the base 118.

Steam ejector tube 84 preferably is in the configuration disclosed in the drawings although the present invention contemplates the usage of a steam ejector tube which is straight or angled (rather than curved) or which does not have a restricted throat portion. However, these variations would result in a loss of efficiency of tube 84 as would be understood from reading points 1, 2, and 3 in the "summary of the invention" in this patent.

In terms of modifications of the structure disclosed hereinbefore, the present invention also contemplates an evaporation chamber in which the lower wall engages the bottom of the tray rather than spaced therefrom. In such event, openings would be provided circumferentially of the lower wall to permit water to enter the evaporation chamber from the main compartment. Although the operation of the humidifier of the present invention would not materially change, a problem would arise in that the openings, in time, would become clogged by deposits from the water or other liquids used, to thereby impede the flow of water between the main compartment and the evaporation chamber.

From the foregoing, it is apparent that the present invention provides an improved and novel humidifier which utilizes a simple and effective steam ejector tube in combination with a steam nozzle through which a high velocity jet is produced under the constant pressure by reason of a differential head of water in the water supply compartment as constituted by the main compartment and the filling compartment of the base.

By utilizing the phenomena of entrainment, negative pressure and buoyancy a uniform and desired mixture of steam and air at a temperature below the painful range is obtained without the use of relatively expensive motor driven blowers and the like, as well a components with moving parts. The invention thus obviates the need of fans, motors, electric controls and the like, and the assembly costs required of them as well as maintenance costs. Furthermore, the pressure drop through the air filter, where used, is overcome by the present invention which adds to the value of same.

Although several embodiments of the present invention have been disclosed and described herein, it may be readily understood that other variations of the invention may be practiced which still will be embraced by the spirit of the invention and covered by the claims which follow.

What is claimed is:

1. A portable warm air humidifier, comprising:

a water container having a discharge opening, a top portion housing having a portion defining an evaporation chamber for collecting vapor, said top portion housing having a vapor outlet opening for discharging vapor collected from said evaporation chamber, a heating element provided within said evaporation chamber, and a base having a main compartment and a filling compartment in communication with each other, said water container and said top portion housing supported and accommodated on said base in cooperative relationship with said main and said filling compartments, said water container and said top portion housing being disposed in juxtaposition with each other and movable and displaceable from and with respect to said compartments on said base so as to provide access to said compartments and said heating element, said water container having said discharge opening projecting into said filling compartment to supply water thereto and to said top portion housing projecting into said main compartment to immerse said heating element in water in said main compartment to effect the vaporization of water into vapor, said top portion housing when moved and displaced in a direction away from said main compartment effecting the withdrawal of said heating element from said main compartment to permit access to said heating element and to the interior of said main compartment, and said evaporation chamber defining a restricted enclosure enclosing said heating element, an open bottom end portion of said evaporation chamber defining a passageway providing water communication between said main compartment and said restricted enclosure and physical access to said heating element so as to permit cleaning thereof.

2. The humidifier of claim 1 further comprising switch means operatively connected to said heating element and adapted to automatically provide deenergization thereof in response to sensing that said heating element is not immersed in water.

3. A portable warm air humidifier comprising:

a base;

a water container supported on said base and having a discharge opening;

a top portion housing supported on said base;

said base having a filling compartment in fluid communication with said discharge opening of said water container; and said base having a main compartment in fluid communication with said top portion housing and with said filling compartment thereby providing a water flowpath between said main and said filling compartments;

said top portion housing defining a portion for the collection of water vapor and provided with an outlet opening to permit the escape of vapor from said top portion housing, and having a heating element projecting into said main compartment;

an enclosure means mounted on said top portion housing defining a chamber enclosing said heating element, said enclosure means defining a passageway providing water communication between said main compartment and said enclosure means and providing physical access to said heating element so as to permit cleaning thereof, said enclosure means communicating with said outlet opening, said water container and said top portion housing moveable and displaceable from and with respect to said filling compartment and said main compartment so as to provide physical access to said filling compartment and said main compartment and said heating element so as to permit cleaning thereof.

4. The humidifier of claim 3 further comprising a switch operatively connected to said heating element and adapted to automatically provide deenergization thereof in response to sensing that said heating element is not immersed in said water.

5. A humidifier comprising:

a base means defining a main compartment;

a water container removably supported on said base means and having a discharge opening communicating with said main compartment and adapted to maintain a given level of water therein; and a top portion housing mounted on said base means and separable from said base means so as to provide access to said main compartment;

said top portion housing comprising an electrically energized resistive heating element projecting into said main compartment and adapted to induce evaporation of water contained therein, and a vapor passage defining means communication with said main compartment so as to receive vapor therefrom and an outlet opening for discharging the vapor received from said main compartment.

6. A humidifier comprising:

a base means defining a water supply compartment;

a water container removably mounted on said base means communicating with said water supply compartment and adapted to maintain a given level of water therein;

a top portion housing mounted on said base means and comprising an electrically energized heating element projecting into said water supply compartment and adapted to induce evaporation of water contained therein, and a vapor passage communicating with said water supply compartment so as to receive vapor therefrom, and an outlet opening for discharging the vapor received from said water supply compartment, said top portion housing removable from said base means so as to allow access to said heating element and said water supply compartment;

said water container and said top portion housing moveable and displaceable from and with respect to said water supply compartment so as to provide physical access to said heating element and said water supply compartment so as to permit cleaning thereof;

electrical supply means for supplying electrical energy to said heating element; and an evaporation chamber defining a restricted enclosure enclosing said heating element, said evaporation chamber defining a passageway providing physical access to said heating element.

7. A humidifier comprising:

a base means defining a water supply compartment;

a water container removably supported on said base means and adapted to maintain a given water level in said water supply compartment; and a top portion housing removably supported on said base means adjacent to said water container, said top portion housing comprising an electrically energized resistive heating element projecting into said water supply compartment, and wherein said top portion housing and said water container substantially cover said base means, said water container and said top portion housing displaceable from said base means so as to provide access to said water supply compartment and said heating element to facilitate cleaning thereof.

8. A humidifier apparatus comprising:

a base means devoid of electrical components and circuitry and defining a water supply compartment for receiving water;

a top portion housing mounted on said base means, said top portion housing retaining all electrical components and circuitry of said apparatus and comprising an electrically energized heating element for inducing a dispersion of water within said water supply compartment, said top portion housing movable with respect to said base means so as to provide access to said heating element and said water supply compartment;

a water container for supplying water to said compartment and mounted on said base means adjacent to said top portion; and a switch operatively coupled to said hearing element and adapted in an active state to cause energization thereof and in inactive state to cause deenergization thereof and adapted to provide said inactive state thereof in response to sensing that said heating element is not immersed in water.

9. A humidifier comprising:

a base means defining a main compartment;

a water container removably supported on said base means and having a discharge opening communicating with said main compartment and adapted to maintain a given level of water therein;

a top portion housing mounted on said base means, said top portion housing comprising an electrically energized heating element projecting into said main compartment and adapted to induce evaporation of water contained therein, and a vapor passage communicating with said main compartment so as to receive vapor therefrom and communicating with an outlet opening on said top portion housing for discharging the vapor received from said main compartment, said top portion housing moveable with respect to said base means so as to provide access to said heating element and said main compartment; and a switch operatively connected to said heating element and adapted to automatically provided deenergization thereof in response to sensing that said heating element is not immersed in water.

10. A humidifier comprising:

a base means defining a main compartment;

a water container removably supported on said base means and having a discharge opening communicating with said main compartment and adapted to maintain a given level of water therein;

a top portion housing removably mounted on said base means and comprising an electrically energized heating element projecting into said main compartment and adapted to induce evaporation of water contained therein, said top portion housing provided with means for receiving and discharging vapor from said main compartment; and electrical supply means for supplying electrical energy to said heating element; and an evaporation chamber mounted on said top portion housing and defining a restricted enclosing said heating element, an open bottom end of said evaporation chamber defining a passageway providing water communication between said main compartment and said evaporation chamber and providing physical access to said heating element so as to permit cleaning thereof.

11. The humidifier of claim 10 further comprising switch means operatively connected to said heating element and adapted to automatically provide deenergization thereof in response to sensing that said heating element is not immersed in water.

12. A humidifier comprising:

a base means defining a water supply compartment including a main compartment and a filling compartment communicating with said main compartment;

a water container removably supported on said base means and having a discharge opening communicating with said filling compartment and adapted to maintain a given level of water in said main compartment;

a top portion housing removably mounted on said base means and comprising an electrically energized heating element projecting into said main compartment and adapted to induce evaporation of water contained therein, and a vapor passage communicating with said main compartment so as to receive vapor therefrom and communicating with an outlet opening for discharging the vapor received from said main compartment; and electrical supply means for supplying electrical energy to said heating element.

13. A portable warm air humidifier, comprising:

a removable water container having a discharge opening, a top portion housing defining a vapor passage and having an inverted cup shaped portion defining an evaporation chamber for the collection of vapor, and having a vapor outlet opening for the discharge of vapor, and a heating element provided with said evaporation chamber, a base having a water supply compartment in fluid communication with said water container and said heating element, said water container and said top portion housing supported on said base in cooperative relationship with said water supply compartment, said water container and said top portion housing being disposed in juxtaposition with each other and movable and displaceable from and with respect to said water supply compartment, said water container having its discharge opening projecting into said water supply compartment to supply water thereto and to said evaporation chamber, said top portion housing projecting into said water supply compartment to immerse said heating element in water in said water supply compartment to effect the vaporization of water into vapor, said top portion housing when moved and displaced in a direction away from said water supply compartment effects the withdrawal of said heating element from said water supply compartment to permit access to said heating element and to the interior of said water supply compartment, said vapor passage of said top portion housing communicating with said heating element to receive vapor generated therefrom, said top portion housing outlet opening communicating with said vapor passage for discharge of vapor received from said evaporation chamber, said evaporation chamber defining a restricted enclosure enclosing said heating element, a portion of said evaporation chamber defining a passageway providing water communication between said water supply compartment and said evaporation chamber and providing physical access to said heating element so as to permit cleaning thereof, and a switch operatively connected to said heating element and adapted to automatically provide deenergization thereof in response to sensing that said heating element is not immersed in water.

* * * * *